US008544769B2

(12) United States Patent
Calla et al.

(10) Patent No.: US 8,544,769 B2
(45) Date of Patent: Oct. 1, 2013

(54) MULTI-NOZZLE SPRAY GUN

(75) Inventors: Eklavya Calla, Karnataka (IN); Viswanathan Venkatachalapathy, Karnataka (IN)

(73) Assignee: General Electric Company, Schenectady, NY (US)

( * ) Notice: Subject to any disclaimer, the term of this patent is extended or adjusted under 35 U.S.C. 154(b) by 236 days.

(21) Appl. No.: 13/190,762

(22) Filed: Jul. 26, 2011

(65) Prior Publication Data

US 2013/0026247 A1 Jan. 31, 2013

(51) Int. Cl.
*A62C 2/08* (2006.01)

(52) U.S. Cl.
USPC ..... 239/548; 239/549; 239/594

(58) Field of Classification Search
USPC ..... 239/548, 549, 551, 553.5, 565, 589, 239/590.5, 592, 593, 594, 11
See application file for complete search history.

(56) References Cited

U.S. PATENT DOCUMENTS

| | | | | |
|---|---|---|---|---|
| 2,724,583 | A * | 11/1955 | Targosh et al. | 239/311 |
| 3,692,501 | A | 9/1972 | Hoppin et al. | |
| 3,769,689 | A | 11/1973 | Little | |
| 3,864,093 | A | 2/1975 | Wolfla | |
| 4,124,737 | A | 11/1978 | Wolfla et al. | |
| 4,528,247 | A | 7/1985 | Mizuhara | |
| 4,630,692 | A | 12/1986 | Ecer | |
| 5,062,205 | A | 11/1991 | Fraser | |
| 5,141,821 | A | 8/1992 | Lugscheider et al. | |
| 5,181,728 | A | 1/1993 | Stec | |
| 5,302,414 | A | 4/1994 | Alkhimov et al. | |
| 5,316,866 | A | 5/1994 | Goldman et al. | |
| 6,186,508 | B1 | 2/2001 | Zajchowski et al. | |
| 6,244,599 | B1 | 6/2001 | Braun et al. | |
| 6,331,217 | B1 | 12/2001 | Burke et al. | |
| 6,491,208 | B2 | 12/2002 | James et al. | |
| 6,827,969 | B1 | 12/2004 | Skoog et al. | |
| 6,905,728 | B1 | 6/2005 | Hu et al. | |
| 6,908,288 | B2 | 6/2005 | Jackson et al. | |

(Continued)

FOREIGN PATENT DOCUMENTS

| | | |
|---|---|---|
| EP | 1215301 A1 | 6/2002 |
| EP | 1462546 A2 | 9/2004 |
| EP | 1806429 A1 | 7/2007 |
| EP | 2072634 A2 | 6/2009 |

OTHER PUBLICATIONS

L. Ajdelsztajn, et al.; "Cold Spray Deposition of Nanocrystalline Aluminum Alloys"; Metallurgical and Materials Transactions, vol. 36A, Mar. 2005, pp. 657-666.

(Continued)

*Primary Examiner* — Davis Hwu
(74) *Attorney, Agent, or Firm* — Cantor Colburn LLP

(57) ABSTRACT

A spray apparatus includes a body having an outer surface and an interior portion, and a first nozzle arranged in the interior portion of the body. The first nozzle includes a first material inlet, a first convergent region, a first throat region, a first divergent region, and a first outlet. The first throat region and first outlet establish a first expansion ratio. A second nozzle is arranged in the interior portion of the body adjacent the first nozzle. The second nozzle includes a second material inlet, a second convergent region, a second throat region, a second divergent region, and a second outlet. The second throat region and the second outlet establish a second expansion ratio that is distinct from the first expansion ratio.

20 Claims, 10 Drawing Sheets

(56) References Cited

U.S. PATENT DOCUMENTS

| | | | |
|---|---|---|---|
| 6,968,990 | B2 | 11/2005 | Ott et al. |
| 7,150,091 | B2 | 12/2006 | Mall et al. |
| 7,316,057 | B2 | 1/2008 | Seth |
| 7,344,675 | B2 | 3/2008 | Van Daam et al. |
| 7,378,132 | B2 | 5/2008 | Renteria et al. |
| 2003/0141666 | A1 | 7/2003 | Crudgington et al. |
| 2005/0087584 | A1 | 4/2005 | Abdo et al. |
| 2005/0118330 | A1 | 6/2005 | Clark et al. |
| 2006/0172073 | A1 | 8/2006 | Groza et al. |
| 2007/0116890 | A1 | 5/2007 | Adams et al. |
| 2007/0289490 | A1 | 12/2007 | Jabado et al. |
| 2008/0099538 | A1 | 5/2008 | DeBiccari et al. |
| 2008/0166585 | A1 | 7/2008 | Allen et al. |
| 2009/0056620 | A1 | 3/2009 | Oda et al. |
| 2009/0256010 | A1 | 10/2009 | Golna et al. |
| 2010/0327535 | A1 | 12/2010 | Grace et al. |

OTHER PUBLICATIONS

L. Ajdelsztajn, et al.,; "Synthesis and Mechanical Properties of Nanocrystalline Ni Coatings Produced by Cold Gas Dynamic Spraying"; Surface & Coatings Technology 201 (2006); pp. 1116-1172; www. sciencedirect.com.

ASM International, Materials Park, Ohio, ASM Specialty Handbook: Nickel, Cobalt, and Their Alloys, "Metallography and Microstructures of Heat Resistant Alloys", Dec. 2000, pp. 302-304.

Eklavya Calla; "Cold Gas Spraying of Copper and Tin onto Metallic and Non Metallic Substrates"; The University of Nottingham; Thesis, Nov. 2005, pp. 1-327.

Nancy Rashid, Ph.D., University of California, Davis; "Unique Nanocrystalline Coatings and Composites for Extreme Applications"; NANOWorld 2004, Patent Pending.

* cited by examiner

MULTI-NOZZLE SPRAY GUN

BACKGROUND OF THE INVENTION

The subject matter disclosed herein relates to the art of spraying and, more particularly, to a spray gun having multiple independently controllable nozzles.

Conventionally, spray techniques are generally used to provide a surface treatment to a component. Cold spray techniques, for example, are employed when it is desired to apply a coating without adding heat or the like to affect a bond between the component to be coated and a coating material. Other applications for cold spraying include constructing free-form structures.

Cold spray techniques utilize a cold spray gun that delivers particles onto a surface at high velocity. The particular velocity used is generally dependent upon the particles being sprayed. Harder particles require spraying at higher velocities to ensure adhesion while lower velocities may be acceptable to facilitate adhesion of softer particles. As soft and hard particles required different velocities, cold spraying composite materials presents various challenges. Currently, there are two techniques for achieving a cold sprayed coating formed from hard and soft particles. In one technique, a first layer is formed by applying either hard or soft particles. After applying the first layer, a second layer including the other of the hard and soft particles is applied. In another technique, hard and soft particles are mixed to form a composite mixture that is delivered into a surface. An application velocity for the composite material is chosen that facilitates adhesion of the harder particles without causing damage to the softer particles. Often times, establishing a velocity that achieves both goals is not possible.

BRIEF DESCRIPTION OF THE INVENTION

According to one aspect of the exemplary embodiment, a spray apparatus includes a body having an outer surface and an interior portion, and a first nozzle arranged in the interior portion of the body. The first nozzle includes a first material inlet member and a first convergent region, a first throat region, a first divergent region, and a first outlet. The first throat region and first outlet establish a first expansion ratio. A second nozzle is arranged in the interior portion of the body adjacent the first nozzle. The second nozzle includes a second material inlet member and a second convergent region, a second throat region, a second divergent region, and a second outlet. The second throat region and the second outlet establish a second expansion ratio that is distinct from the first expansion ratio.

According to another aspect of the exemplary embodiment, a method of spraying a composite layer onto a substrate includes discharging a first material from a first nozzle in a spray gun at a first velocity, and discharging a second material from a second nozzle in the spray gun at a second velocity distinct from the first velocity.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
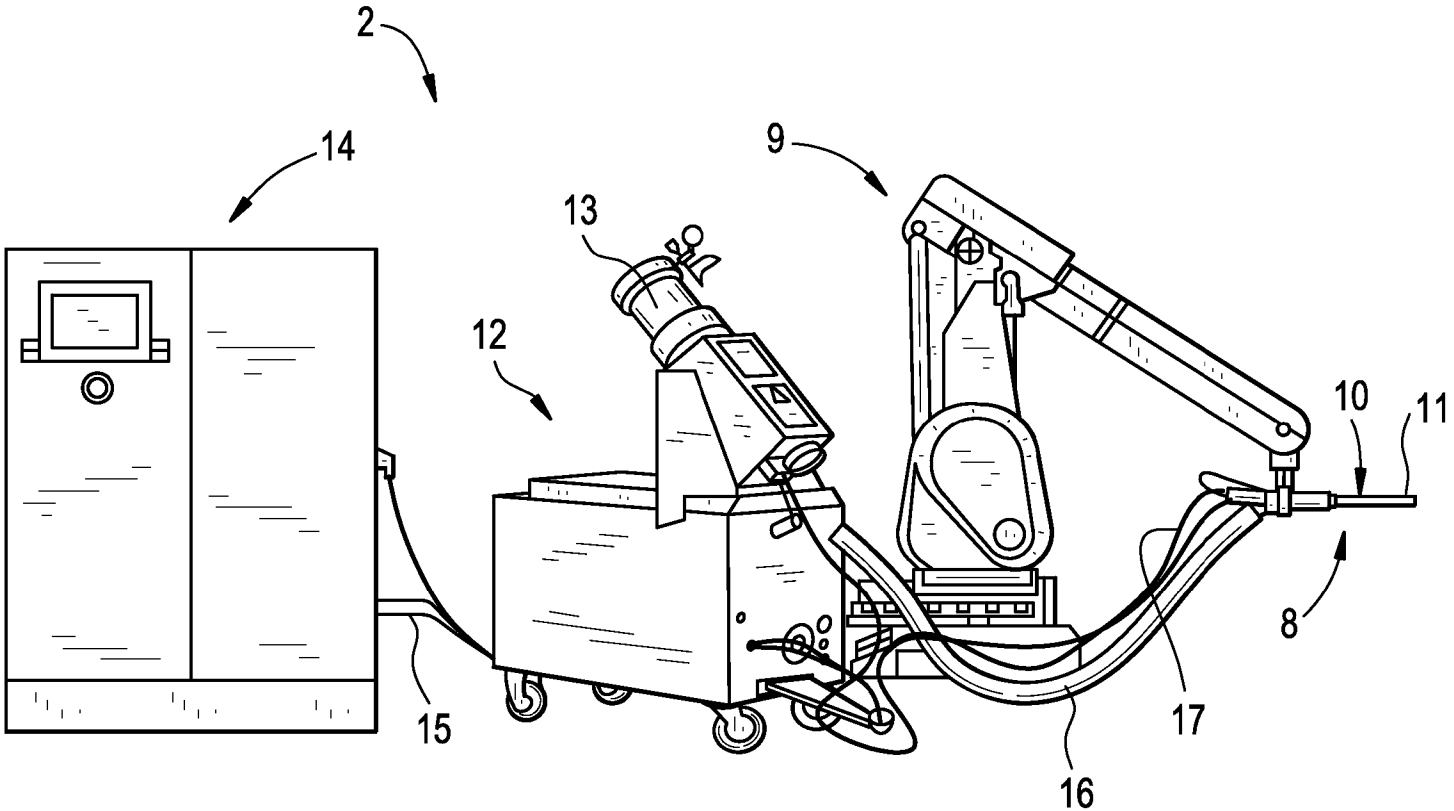
FIG. 1 is a perspective view of a spray apparatus including a multi-nozzle cold spray gun in accordance with an exemplary embodiment.

With initial reference to FIG. 1, a spray apparatus is indicated generally at 2. In the exemplary embodiment shown, spray apparatus comprises a cold spray apparatus for spraying cold spray powders. However, it should be understood that spray apparatus 2 could be employed to discharge a variety of materials. Spray apparatus 2 includes a multi-nozzle cold spray gun 8 mounted to a robot arm 9. Of course, multi-nozzle cold spray gun 8 could also be hand held or manipulated by various other devices. Multi-nozzle cold spray gun 8 includes a head portion 10 having an outlet 11 and is operatively connected to a gas heater 12 including a powder hopper 13. Of course it should be understood that powder hopper 13 could be a separate unit from gas heater 12. Gas heater 12 receives a supply of gas from a gas control module 14 via a hose 15. A portion of the supply of gas from gas control module 14 is diverted to powder hopper 13 to serve as a carrier for the powder. The gas and powder is then directed to multi-nozzle cold spray gun 8 via a process gas supply hose 16 and a powder supply hose 17. Process gas supply hose 16 delivers gas to multi-nozzle cold spray gun 8 while powder supply hose 17 delivers powder from powder hopper 13. The gas and powder pass from multi-nozzle cold spray gun 8 onto a component (not shown) to form a coating. As will become more fully evident below, powder hopper 13 may supply a number of different powder types to multi-nozzle cold spray gun 8 to be delivered onto the component. Thus, powder supply hose 17 may comprise multiple internal passages (not shown), may comprise multiple powder supply hoses (also not shown), or multiple powder hoppers coupled to multiple distinct hoses (not shown).

Figure 2:
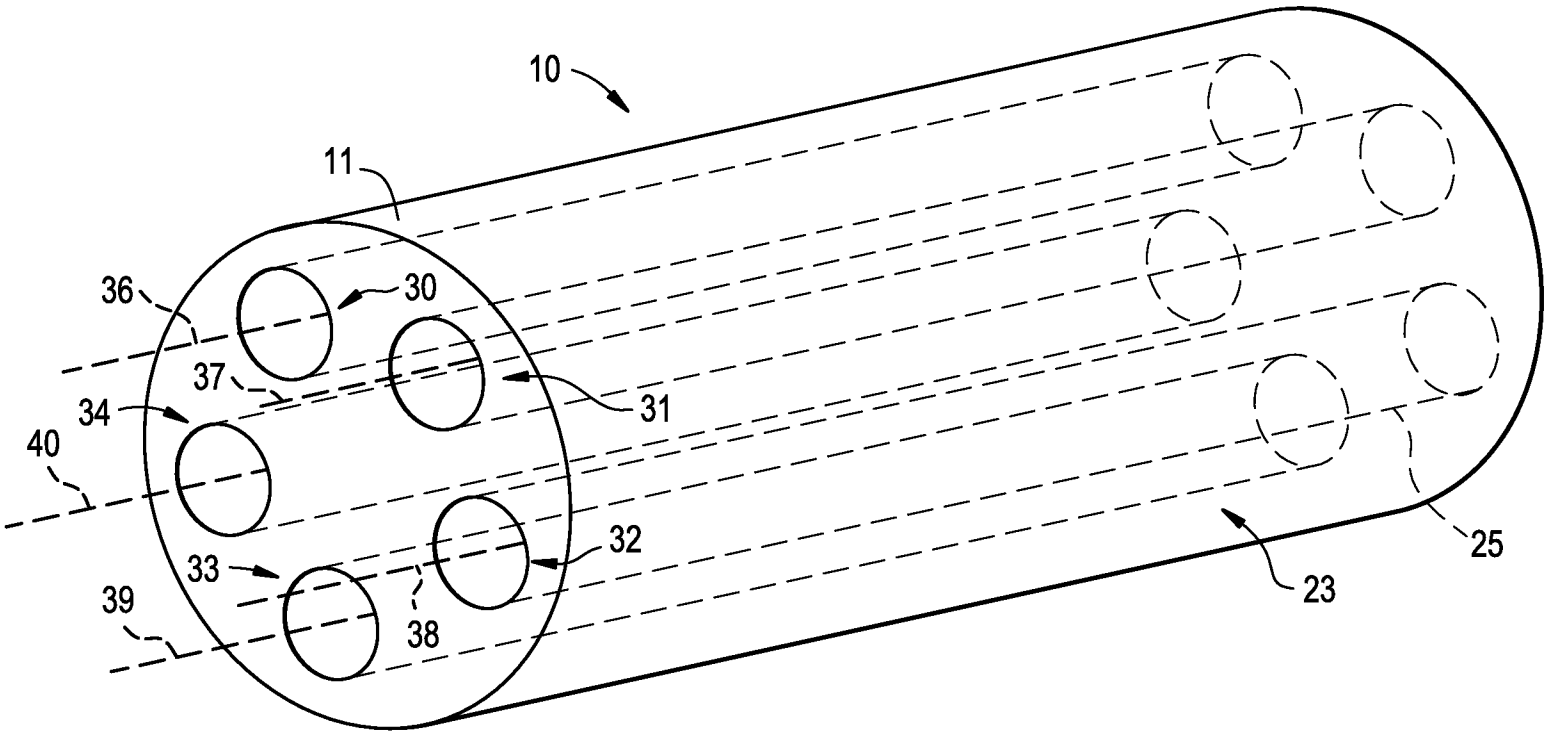
FIG. 2 is a partial perspective view of a head portion of the multi-nozzle cold spray gun of FIG. 1 in accordance with one aspect of the exemplary embodiment.
Figure 3:
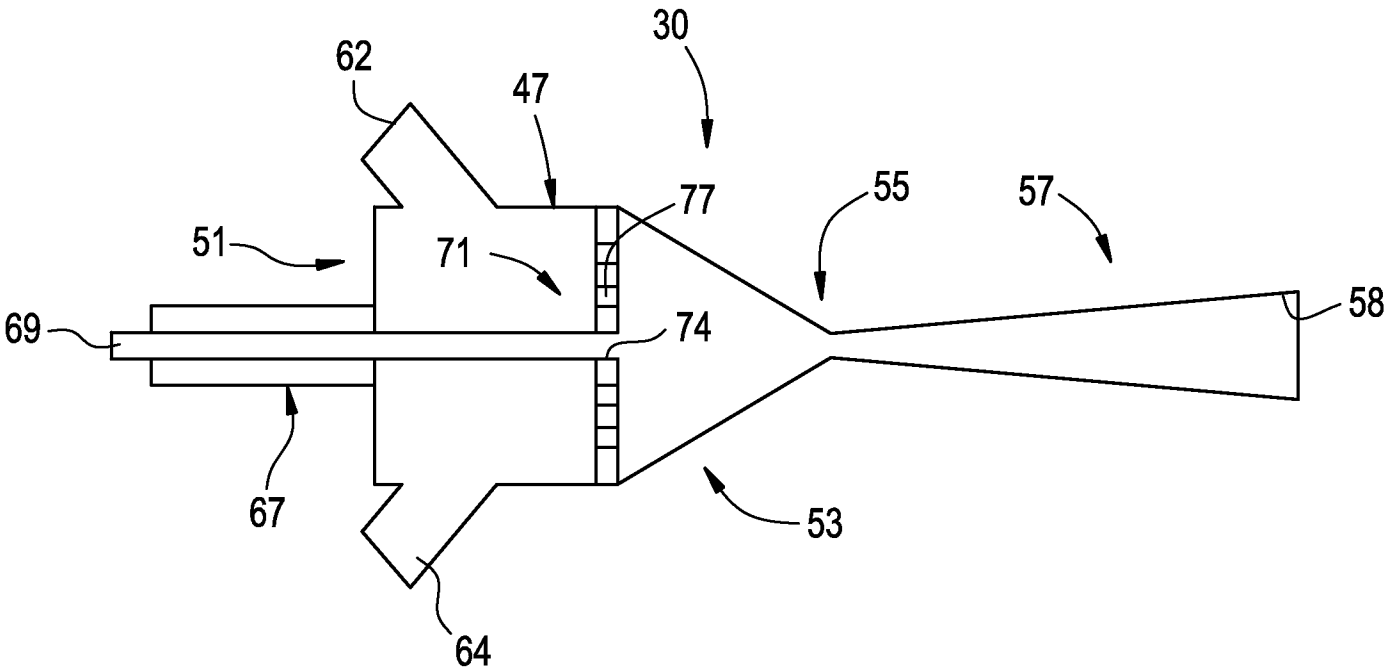
FIG. 3 is a cross-sectional view of one nozzle of the multi-nozzle cold spray gun of FIG. 1.
Figure 4:
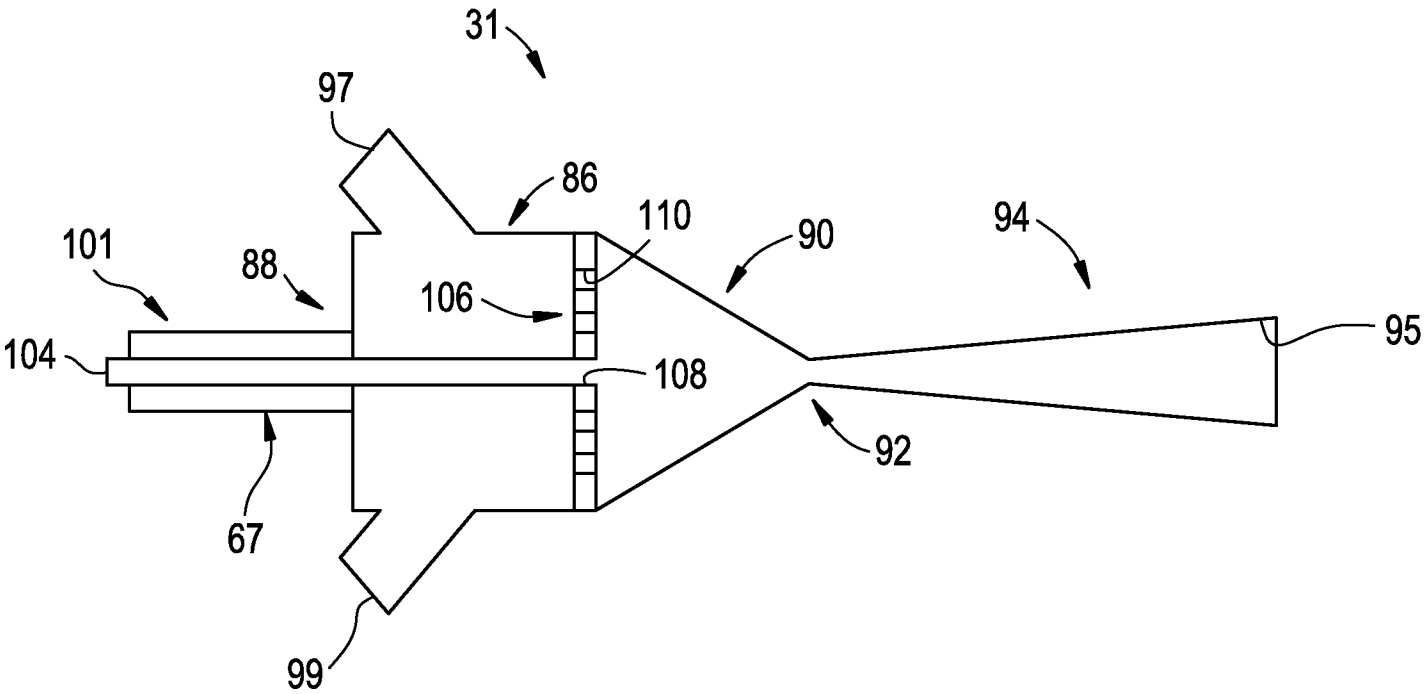
FIG. 4 is a cross-sectional view of another nozzle of the multi-nozzle cold spray gun of FIG. 1.

As best shown in FIG. 2, head portion 10 includes a body 23 having an interior portion 25 within which are arranged multiple, independently fed nozzles 30-34 that are arranged along respective parallel axes 36-40. Nozzles 30-34 accelerate the gas and powder for delivery onto a substrate (not shown). The gas forces the powder onto the substrate at speeds, typically in a range of between 800 m/s to 1500 m/s. The high speed delivery causes the powder to adhere to the component and form a coating. Of course it should be understood that delivery speeds can vary to levels below 800 m/s and above 1500 m/s depending on desired adhesion characteristics and powder type. It should also be understood that powder discharge velocity for each nozzle 30-34 could vary. As each nozzle 30-34 is substantially similar, a detailed description will follow to FIGS. 3 and 4 in describing nozzles 30 and 31 with an understanding that nozzles 32 and 33 include corresponding structure. It should however be understood that each nozzle 30-34 can have a different geometry depending upon various parameters such as process gas type, powder type, and the like.

In accordance with an exemplary embodiment, nozzle 30 includes a nozzle body 47 having an inlet region 51, a convergent region 53, a throat region 55, and a divergent region 57 having an outlet 58. Inlet region 51 includes a process gas inlet 62, a sensor receiver 64, and a powder inlet 67. Process gas inlet 62 is configured to receive process gas from process gas supply hose 16. Sensor receiver 64 supports temperature and/or pressure sensors configured to monitor parameters of the process gas. Powder inlet 67 includes an inlet member 69 that is configured to receive powder through powder supply hose 17, and an outlet member 71 that delivers gas and powder toward outlet 58.

In the exemplary embodiment shown, outlet member 71 is arranged upstream from convergent region 53 and includes a powder outlet 74 and a plurality of gas outlets, one of which is indicated at 77. Of course, a single outlet may also be employed. The process gas serves as a carrier that delivers the powder onto a substrate with the particular geometry of nozzle 30 creating a desired acceleration of the process gas and powder. More specifically, the throat region 55 and outlet 58 establish a particular expansion ratio for nozzle 30 that can be tailored to establish an application velocity associated with particular material properties and based on a desired gas or powder discharge velocity for a desired application. The expansion ratio is defined as a ratio between a cross-sectional area of outlet 58 and throat region 55 as described by the equation below:

$$\frac{A}{A^*} = \frac{1}{M}\left[\frac{2}{\gamma+1}\right]\left[1+\left(\frac{\gamma-1}{2}\right)M^2\right]^{\frac{\gamma+1}{2(\gamma-1)}}$$

Where A is the area of outlet 58 and A* is the area of throat region 55. Gamma is the ratio $C_p/C_v$ of the process gas being used. M is the Mach number predicted by the equation.

Similarly, nozzle 31 includes a nozzle body 86 having an inlet region 88, a convergent region 90, a throat region 92, and a divergent region 94 having an outlet 95. Inlet region 88 includes a process gas inlet 97, a sensor receiver 99, and a powder inlet 101. In a manner similar to that described above, process gas inlet 97 is configured to receive process gas from process gas supply hose 16. Sensor receiver 99 supports temperature and/or pressure sensors configured to monitor parameters of the process gas. Powder inlet 101 includes an inlet member 104 that is configured to receive powder through powder supply hose 17, and an outlet member 106 that delivers gas and powder toward outlet 58.

Powder inlet 101 can receive a powder similar to that supplied to nozzle 30 or an entirely different powder depending upon desired coating characteristics. That is, one of nozzles 30-34 can direct a hard powder onto a substrate and another of nozzles 30-34 can direct a softer powder onto a substrate. In the exemplary embodiment shown, outlet member 106 is arranged upstream from convergent region 90 and includes a powder outlet 108 and a plurality of gas outlets, one of which is indicated at 110. In a manner similar to that described above, throat region 55 and outlet 58 establish a particular expansion ratio for nozzle 31 that can be tailored to particular parameters based on a desired powder output speed for a desired application. Thus, the expansion ration for each nozzle 30-34 can be the same or different depending upon desired powder application parameters.

With this arrangement, cold spray gun 8 can create a multi-component powder mix that is delivered onto a substrate without the need for multiple distinct applications or tailoring application parameters to accommodate two different powders. In accordance with the exemplary embodiment, each nozzle 30-34 can be independently tailored for a particular gas/powder combination. That is, powder/gas streams from each nozzle 30-34 may be at similar or different/distinct velocities depending upon application parameters associated with powder being employed and/or the substrate being coated.

Figure 5:
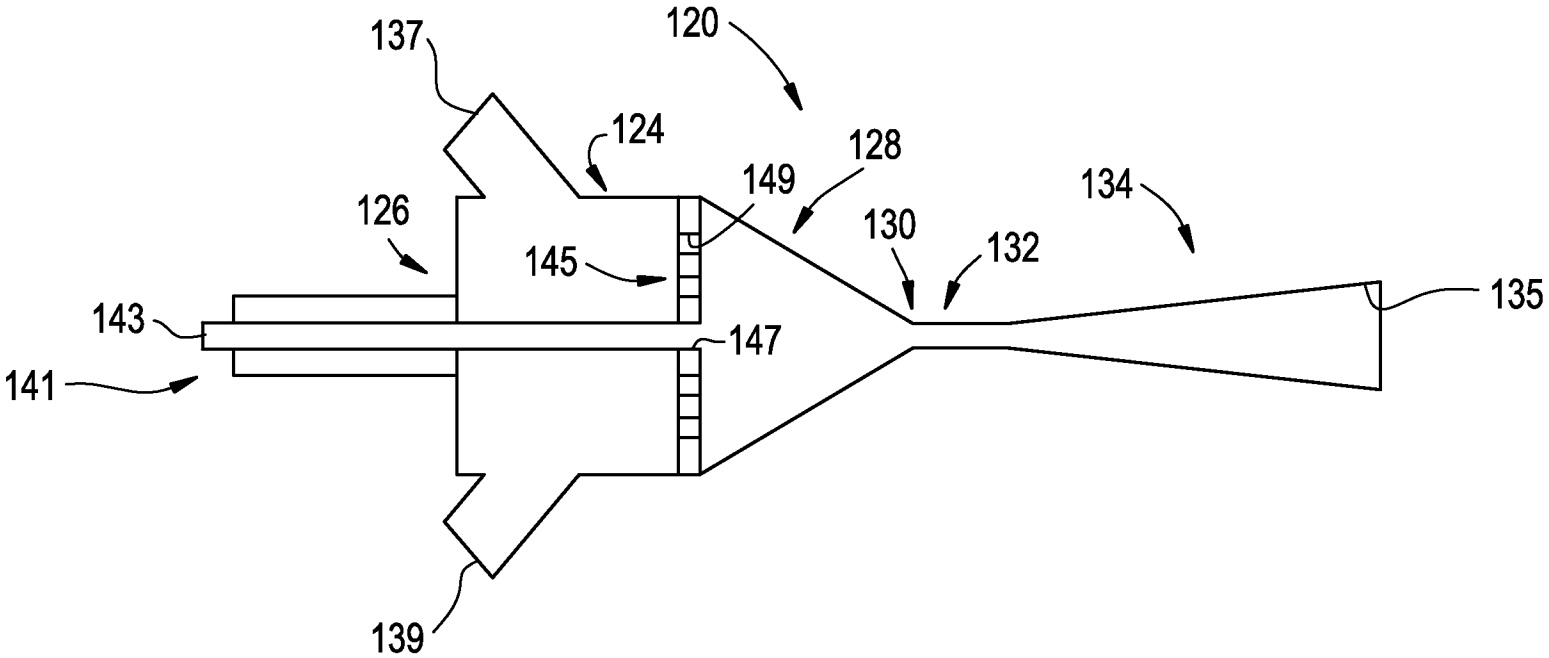
FIG. 5 is a cross-sectional view of a nozzle of the multi-nozzle cold spray gun of FIG. 1 in accordance with another aspect of the exemplary embodiment.

Reference will now be made to FIG. 5 in describing a nozzle 120 in accordance with another aspect of the exemplary embodiment. Nozzle 120 can replace one or more of, and/or augment, nozzles 30-34 depending upon desired application parameters. Nozzle 120 includes a nozzle body 124 having an inlet region 126, a convergent region 128, a throat region 130, a substantially straight region 132, and a divergent region 134 having an outlet 135. In the exemplary embodiment shown, substantially straight region 132 is positioned between throat region 130 and divergent region 134. Inlet region 126 includes a process gas inlet 137, a sensor receiver 139, and a powder inlet 141. As discussed above, process gas inlet 137 is configured to receive process gas from process gas supply hose 16. Sensor receiver 139 supports temperature and/or pressure sensors configured to monitor parameters of the process gas. Powder inlet 141 includes an inlet member 143 that is configured to receive powder through powder supply hose 17, and an outlet member 145 that delivers gas and powder toward outlet 135. Outlet member 145 includes a powder outlet 147 and a plurality of gas outlets, one of which is indicated at 149.

Figure 6:
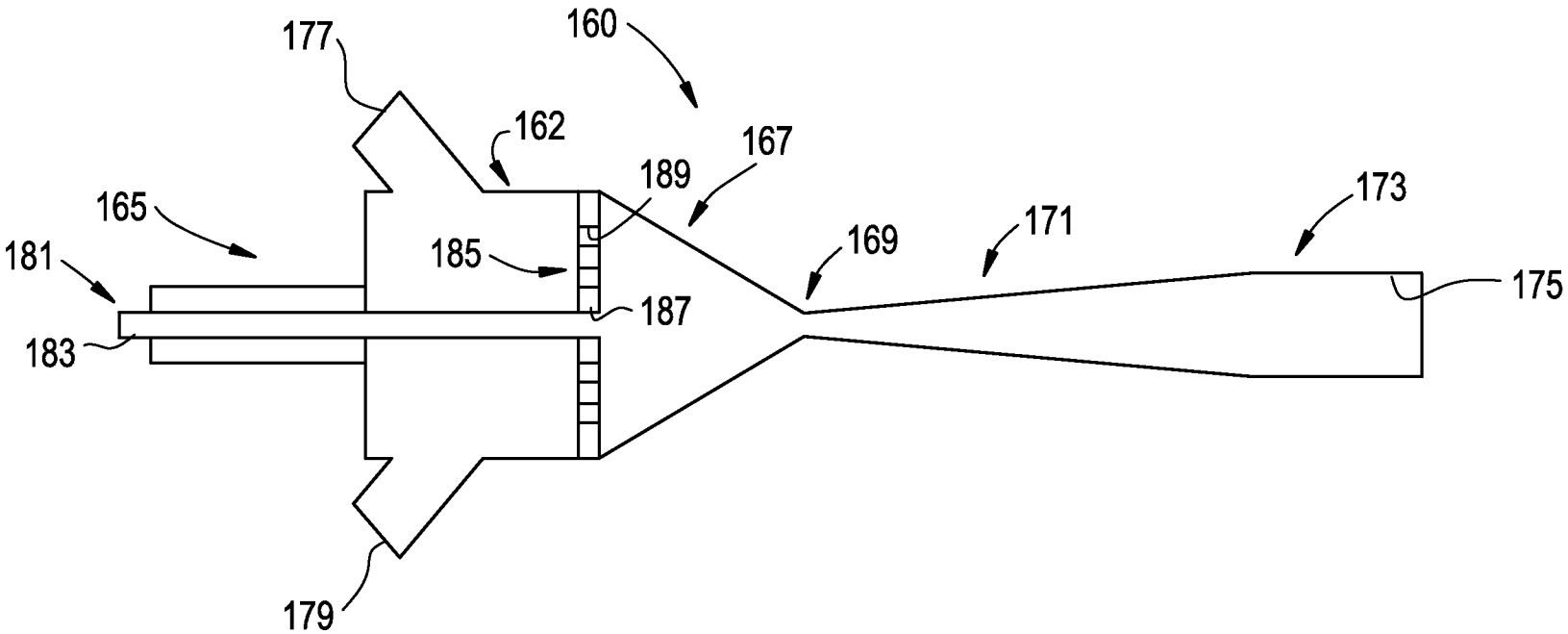
FIG. 6 is a cross-sectional view of a nozzle of the multi-nozzle cold spray gun of FIG. 1 in accordance with yet another aspect of the exemplary embodiment.

Reference will now be made to FIG. 6 in describing a nozzle 160 in accordance with another aspect of the exemplary embodiment. In a manner similar to that discussed above, nozzle 160 can replace one or more of, and/or augment, nozzles 30-34 depending upon desired application parameters. Nozzle 160 includes a nozzle body 162 having an inlet region 165, a convergent region 167, a throat region 169, a divergent region 171, and a substantially straight region 173 having an outlet 175. In the exemplary embodiment shown, substantially straight region 173 is positioned downstream from divergent region 171. Inlet region 165 includes a process gas inlet 177, a sensor receiver 179, and a powder inlet 181. As discussed above, process gas inlet 177 is configured to receive process gas from process gas supply hose 16. Sensor receiver 179 supports temperature and/or pressure sensors configured to monitor parameters of the process gas. Powder inlet 181 includes an inlet member 183 that is configured to receive powder through powder supply hose 17, and an outlet member 185 that delivers gas and powder toward outlet 175. Outlet member 185 includes a powder outlet 187 and a plurality of gas outlets, one of which is indicated at 189.

Figure 7:
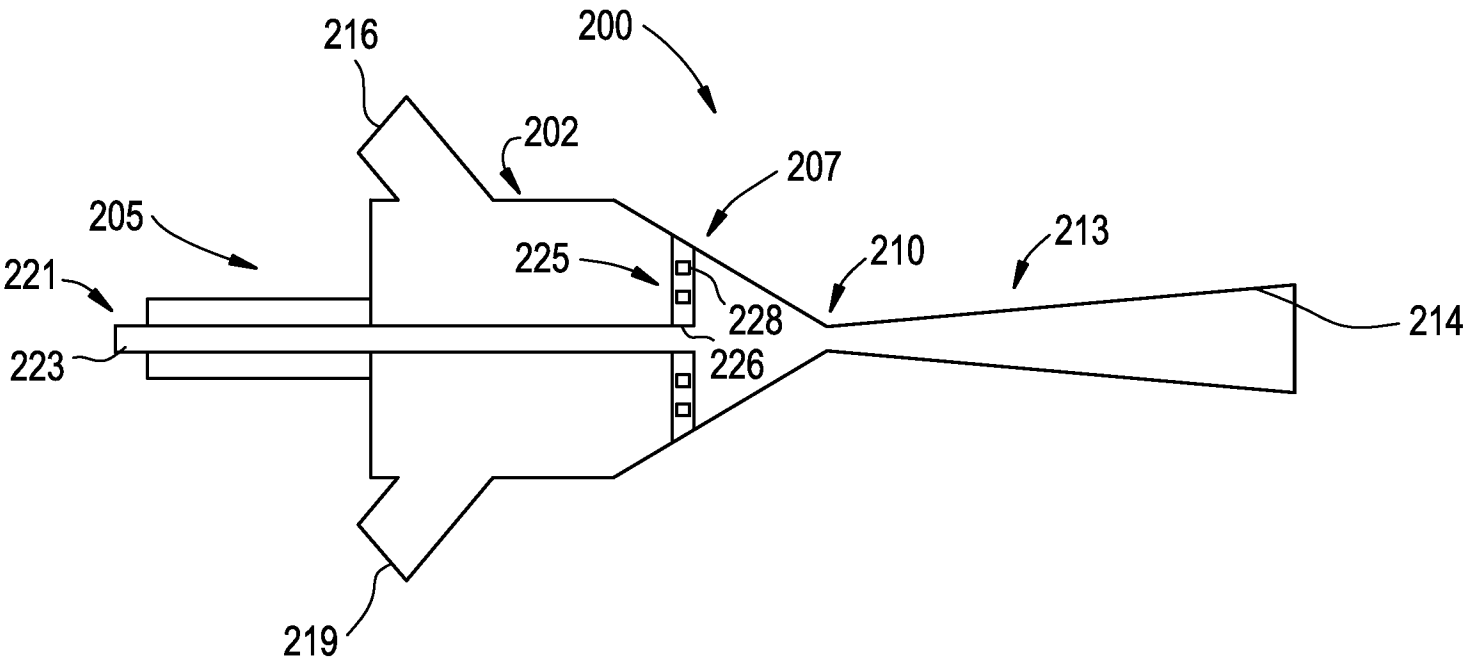
FIG. 7 is a cross-sectional view of a nozzle of the multi-nozzle cold spray gun of FIG. 1 in accordance with still another aspect of the exemplary embodiment.

Reference will now be made to FIG. 7 in describing a nozzle 200 in accordance with another aspect of the exemplary embodiment. In a manner also similar to that discussed above, nozzle 200 can replace one or more of, and/or augment, nozzles 30-34 depending upon desired application parameters. Nozzle 200 includes a nozzle body 202 having an inlet region 205, a convergent region 207, a throat region 210, and a divergent region 213 having an outlet 214. Inlet region 205 includes a process gas inlet 216, a sensor receiver 219, and a powder inlet 221. As discussed above, process gas inlet 216 is configured to receive process gas from process gas supply hose 16. Sensor receiver 219 supports temperature and/or pressure sensors configured to monitor parameters of the process gas. Powder inlet 221 includes an inlet member 223 that is configured to receive powder through powder supply hose 17, and an outlet member 225 that delivers gas and powder toward outlet 214. In accordance with the exemplary embodiment, outlet member 225 is arranged within convergent region 207 and includes a powder outlet 226 and a gas outlet 228. The particular location of outlet member 225 within convergent region 207 can vary and provides a particular acceleration of the gas and powder to establish a desired application parameter.

Figure 8:
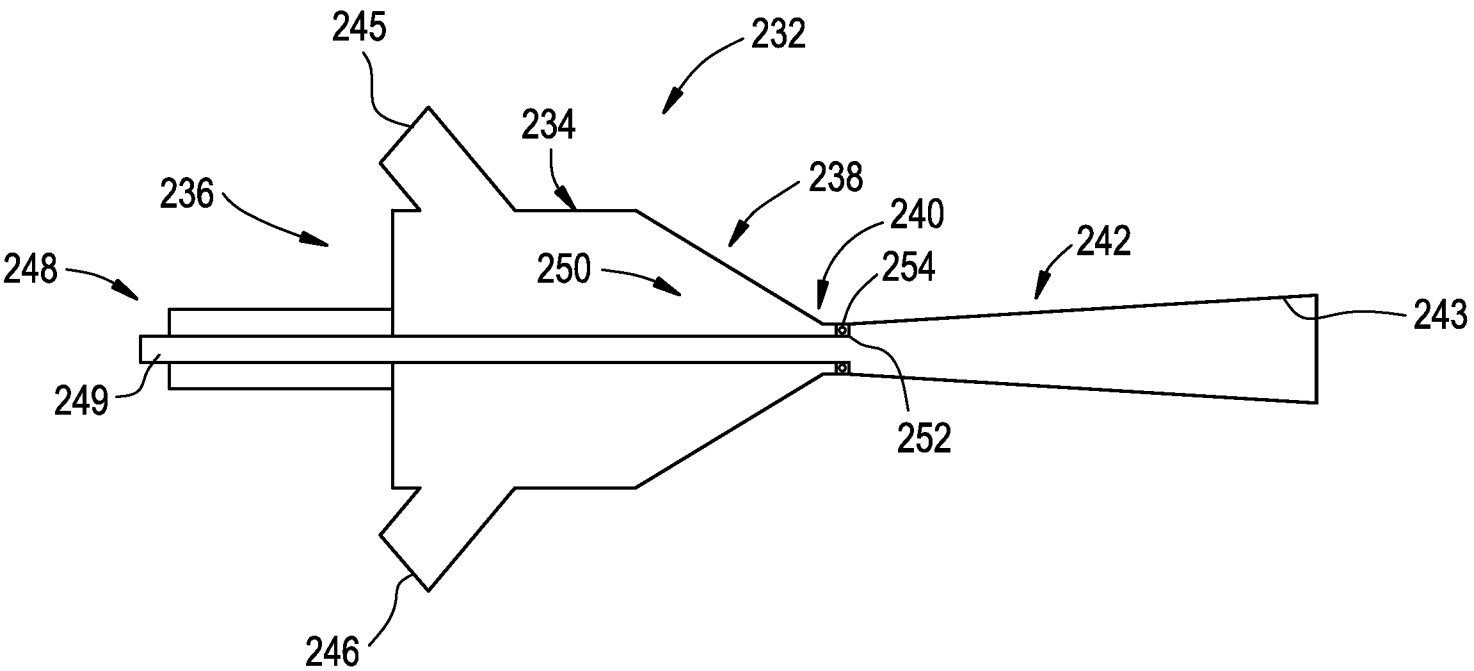
FIG. 8 is a cross-sectional view of a nozzle of the multi-nozzle cold spray gun of FIG. 1 in accordance with still yet another aspect of the exemplary embodiment.

Reference will now be made to FIG. 8 in describing a nozzle 232 in accordance with another aspect of the exemplary embodiment. In a manner similar to that discussed above, nozzle 232 can replace one or more of, and/or augment, nozzles 30-34 depending upon desired application parameters. Nozzle 232 includes a nozzle body 234 having an inlet region 236, a convergent region 238, a throat region 240, and a divergent region 242 having an outlet 243. Inlet region 236 includes a process gas inlet 245, a sensor receiver 246, and a powder inlet 248. As discussed above, process gas inlet 245 is configured to receive process gas from process gas supply hose 16. Sensor receiver 246 supports temperature and/or pressure sensors configured to monitor parameters of the process gas. Powder inlet 248 includes an inlet member 249 that is configured to receive powder through powder supply hose 17, and an outlet member 250 that delivers gas and powder toward outlet 243. In accordance with the exemplary embodiment, outlet member 250 is arranged within throat region 240 and includes a powder outlet 252 and a gas outlet 254. The particular location of outlet member 250 within throat region 240 provides a particular acceleration of the gas and powder to establish a desired application parameter.

Figure 9:
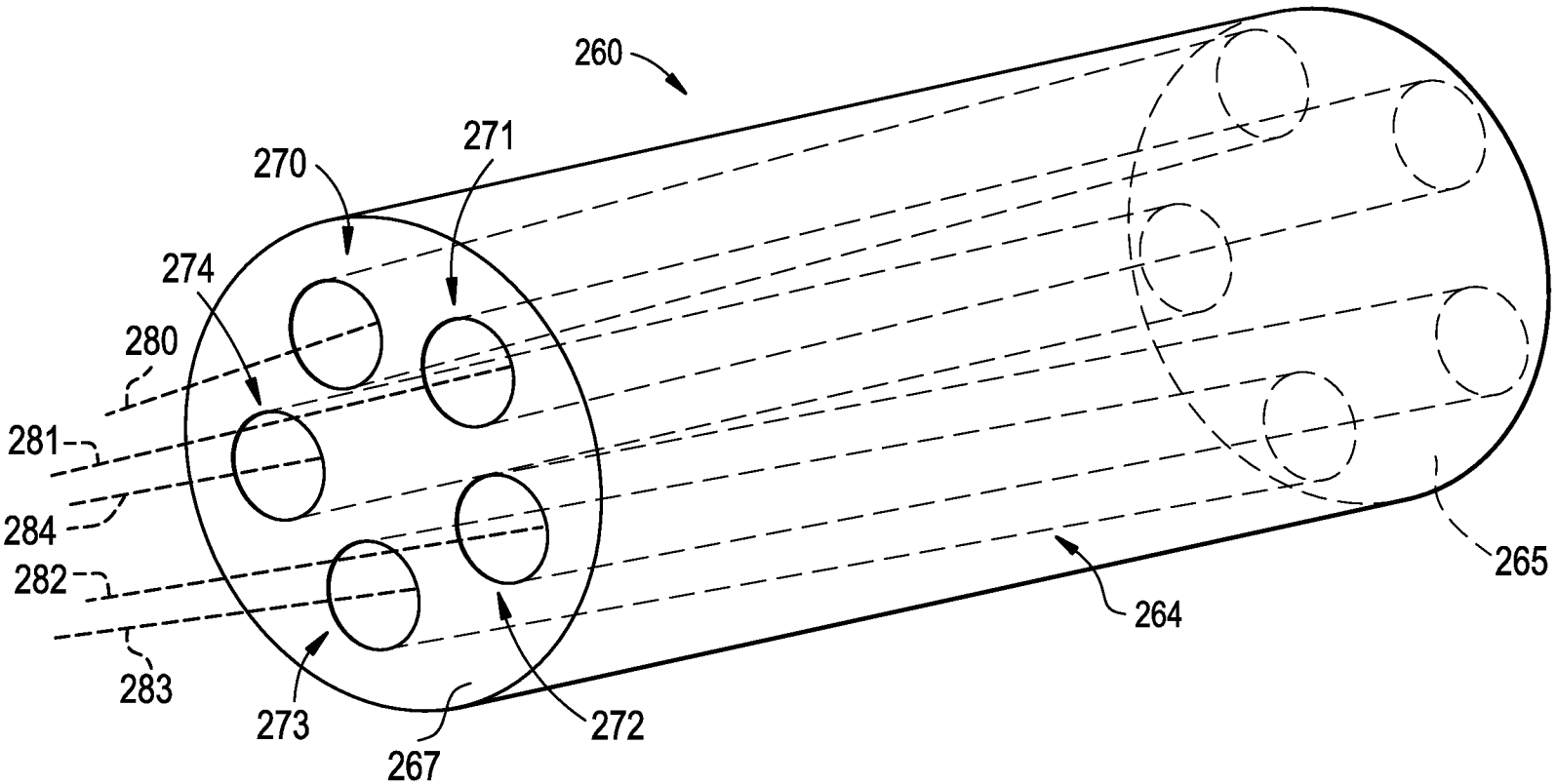
FIG. 9 is a partial perspective view of a head portion of the multi-nozzle cold spray gun of FIG. 1 in accordance with another aspect of the exemplary embodiment.

Reference will now be made to FIG. 9 in describing a head portion 260 of a multi-nozzle cold spray gun (not separately labeled) in accordance with another aspect of the exemplary embodiment. Head portion 260 includes a body 264 having an outlet 267. Body 264 includes an interior portion 265 within which are arranged a plurality of nozzles 270-274. Nozzles 270-274 extend along axes 280-284 that are angled relative to head portion 260. More specifically, axes 280-284 are angled such that powder/gas steams from each nozzle 270-274 converge at a focal point (not shown) downstream from outlet 267. With this arrangement, multiple streams of gas/powder are directed toward a single point on a substrate.

Figure 10:
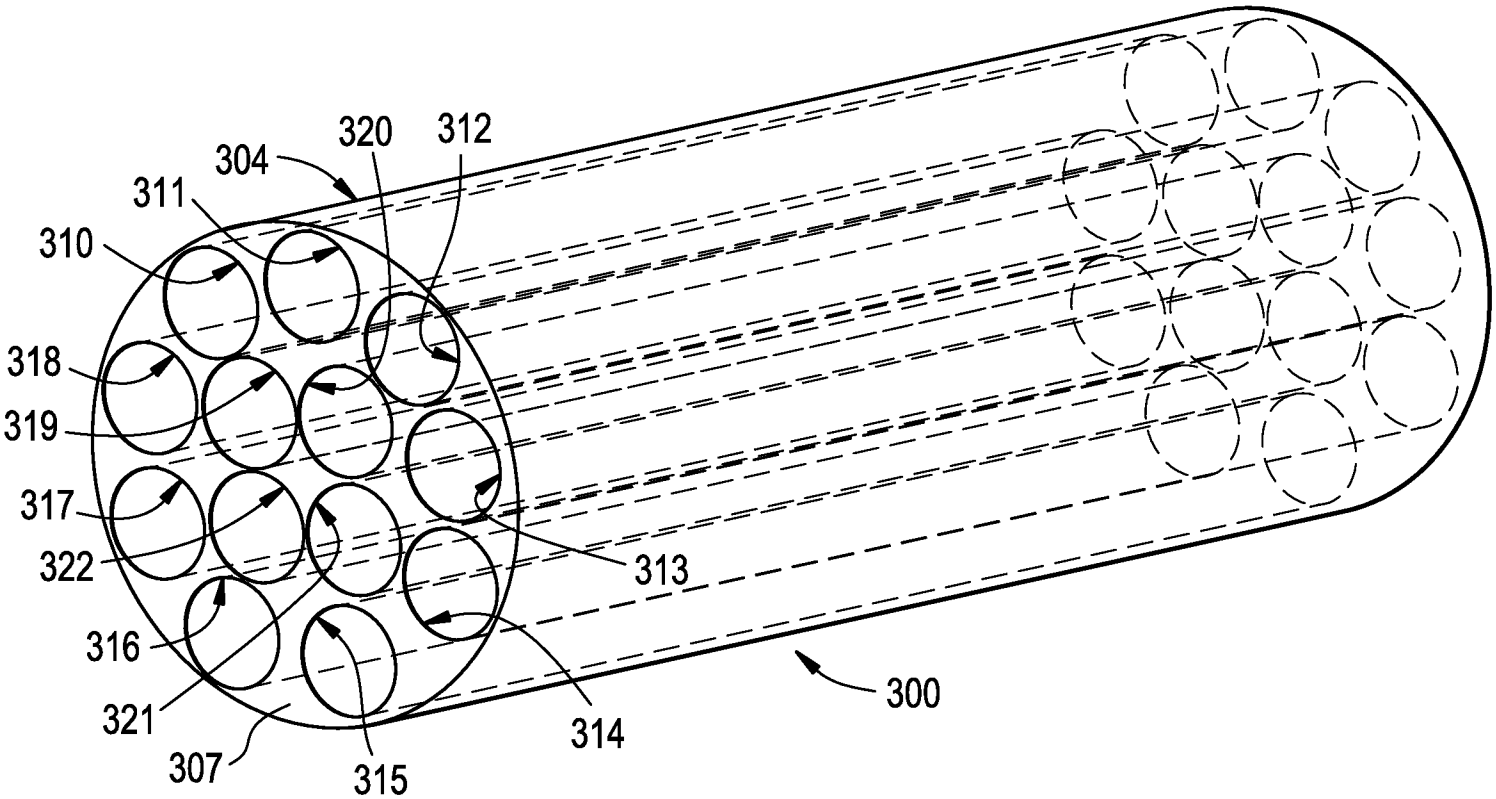
FIG. 10 is a partial perspective view of a head portion of the multi-nozzle cold spray gun of FIG. 1 in accordance with yet another aspect of the exemplary embodiment.

Reference will now be made to FIG. 10 in describing a head portion 300 of a multi-nozzle cold spray gun (not separately labeled) in accordance with yet another exemplary embodiment. Head portion 300 includes a body 304 having an outlet 307. Body 304 includes an interior portion 306 within which are arranged a plurality of independent micro-nozzles 310-322. Micro-nozzles 310-322 can be arranged along parallel axes or converging axes depending upon a desired application. Micro-nozzles 310-322 deliver multiple gas/powder streams onto a substrate. Each micro-nozzle can be configured to pass a similar powder or different powders having similar or different properties such as hardness, composition, morphology, and particle size depending upon the coating desired. Spray parameters like powder feed rate, gas flow, pressure and temperature, type of gas (i.e. helium, nitrogen, air or mixes thereof) can be independently controlled for each nozzle through the controller. More specifically, the present invention describes multiple spray guns that may have distinct designs and which are selectively independently controlled.

At this point it should be appreciated that the exemplary embodiments describe a spray gun having multiple independently controllable nozzles that can be configured to deliver similar or distinct materials onto a substrate. Each nozzle may be configured to have a particular expansion ratio to create a desired material application velocity. In addition, a material introduction point for each nozzle can be tailored to further establish a particular material application velocity. That is, the material may be introduced at a point that is upstream of the convergent region to a point that is within the divergent region to discharge velocity to a desired parameter. It should also be understood, that the number, type, and angle of the nozzles can vary. Also, while shown being configured to establish multiple either parallel or converging powder streams, the cold spray gun could also be configured to include both parallel and converging nozzles. Finally it should be understood that while described in terms of cold spraying powders, other materials including both solids and liquids may be passed through the spray apparatus in accordance with the exemplary embodiment.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A spray apparatus comprising:

a body having an outer surface and an interior portion;

a first nozzle arranged in the interior portion of the body, the first nozzle including a first material inlet, a first convergent region, a first throat region, a first divergent region, and a first outlet, the first throat region and first outlet establishing a first expansion ratio; and a second nozzle arranged in the interior portion of the body adjacent the first nozzle, the second nozzle including a second material inlet, a second convergent region, a second throat region, a second divergent region, and a second outlet, the second throat region and the second outlet establishing a second expansion ratio that is distinct from the first expansion ratio, wherein the first nozzle extends along a first axis in the interior portion of the body and the second nozzle extends along a second axis in the interior portion of the body, the first axis being substantially parallel to the second axis.

2. The spray apparatus according to claim 1, wherein the first nozzle includes a substantially straight region extending from the throat region to the divergent region.

3. The spray nozzle according to claim 1, wherein the first nozzle includes a substantially straight region extending downstream from the divergent region.

4. The spray apparatus according to claim 1, wherein the first material inlet includes a first material outlet member arranged upstream of the first convergent region.

5. The spray apparatus according to claim 1, wherein the first material inlet includes a first material outlet member arranged upstream of the first throat region in the first convergent region.

6. The spray apparatus according to claim 1, wherein the first material inlet includes a first material outlet member arranged at the first throat region.

7. The spray apparatus according to claim 1, wherein the first nozzle includes a first gas inlet and a first sensor receiver, and the second nozzle includes a second gas inlet and a second sensor receiver.

8. The spray apparatus according to claim 1, wherein the first nozzle is configured and disposed to receive a first cold spray powder having a first property at the first material inlet, and the second nozzle is configured and disposed to receive a second cold spray powder having a second property at the second material inlet.

9. The spray apparatus according to claim 8, wherein the first expansion ratio is configured and disposed to establish a first application velocity associated with the first property and the second expansion ratio is configured and disposed to establish a second cold spray powder application velocity associated with the second property.

10. The spray apparatus according to claim 8, wherein the spray apparatus comprises a cold spray gun.

11. A spray apparatus comprising:

a body having an outer surface and an interior portion;

a first nozzle arranged in the interior portion of the body, the first nozzle including a first material inlet, a first convergent region, a first throat region, a first divergent region, and a first outlet, the first throat region and first outlet establishing a first expansion ratio; and a second nozzle arranged in the interior portion of the body adjacent the first nozzle, the second nozzle including a second material inlet, a second convergent region, a second throat region, a second divergent region, and a second outlet, the second throat region and the second outlet establishing a second expansion ratio that is distinct from the first expansion ratio, wherein the first nozzle extends along a first axis in the interior portion of the body and the second nozzle extends along a second axis in the interior portion of the body, the first axis being angled relative to the second axis such that the first and second nozzle are configured and disposed to deliver powder to a single focal point downstream from the first and second outlets.

12. The spray apparatus according to claim 11, wherein the first nozzle includes a substantially straight region extending from the throat region to the divergent region.

13. The spray nozzle according to claim 11, wherein the first nozzle includes a substantially straight region extending downstream from the divergent region.

14. The spray apparatus according to claim 11, wherein the first material inlet includes a first material outlet member arranged upstream of the first convergent region.

15. The spray apparatus according to claim 11, wherein the first material inlet includes a first material outlet member arranged upstream of the first throat region in the first convergent region.

16. The spray apparatus according to claim 11, wherein the first material inlet includes a first material outlet member arranged at the first throat region.

17. The spray apparatus according to claim 11, wherein the first nozzle includes a first gas inlet and a first sensor receiver, and the second nozzle includes a second gas inlet and a second sensor receiver.

18. The spray apparatus according to claim 11, wherein the first nozzle is configured and disposed to receive a first cold spray powder having a first property at the first material inlet, and the second nozzle is configured and disposed to receive a second cold spray powder having a second property at the second material inlet.

19. The spray apparatus according to claim 18, wherein the first expansion ratio is configured and disposed to establish a first application velocity associated with the first property and the second expansion ratio is configured and disposed to establish a second cold spray powder application velocity associated with the second property.

20. The spray apparatus according to claim 18, wherein the spray apparatus comprises a cold spray gun.

* * * * *